US012650273B2

(12) United States Patent
Jeon et al.

(10) Patent No.: US 12,650,273 B2
(45) Date of Patent: Jun. 9, 2026

(54) HEAT EXCHANGER

(71) Applicant: Hanon Systems, Daejeon (KR)

(72) Inventors: Young-Ha Jeon, Daejeon (KR); Seung Su Baek, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 86 days.

(21) Appl. No.: 18/721,278

(22) PCT Filed: Dec. 21, 2022

(86) PCT No.: PCT/KR2022/020975
§ 371 (c)(1),
(2) Date: Jun. 18, 2024

(87) PCT Pub. No.: WO2023/121302
PCT Pub. Date: Jun. 29, 2023

(65) Prior Publication Data

US 2025/0052523 A1 Feb. 13, 2025

(30) Foreign Application Priority Data

Dec. 22, 2021 (KR) ..... 10-2021-0184779
Dec. 20, 2022 (KR) ..... 10-2022-0179842

(51) Int. Cl.
*F28F 9/02* (2006.01)
*F28D 1/047* (2006.01)
(Continued)

(52) U.S. Cl.
CPC ..... *F28F 9/0246* (2013.01); *F28D 1/047* (2013.01); *F28F 9/22* (2013.01); *F28F 17/00* (2013.01); *F28F 2009/224* (2013.01)

(58) Field of Classification Search
CPC .. F28D 1/047; F28D 1/05391; F28D 1/05383; F28F 9/024; F28F 9/22;
(Continued)

(56) References Cited

U.S. PATENT DOCUMENTS 8,353,330 B2 * 1/2013 Lim ..... B23P 15/26 165/76
9,157,688 B2 * 10/2015 Samuelson ..... F28F 9/262
(Continued)

FOREIGN PATENT DOCUMENTS

DE 112013002660 T5 * 3/2015 ..... F28F 9/0246
JP H07305990 A 11/1995
(Continued)

OTHER PUBLICATIONS

English translation of KR 20200080157A (Year: 2020).*
International Search Report issued in PCT/KR2022/020975 on Mar. 24, 2023.

*Primary Examiner* — Tho V Duong
(74) *Attorney, Agent, or Firm* — NORTON ROSE FULBRIGHT US LLP

(57) ABSTRACT

The present invention relates to a heat exchanger capable of ensuring sufficient cooling performance and drainage performance even in a narrow width, and the heat exchanger includes first and second header tanks into and from which a cooling fluid is introduced and discharged, the first and second header tanks being spaced apart from each other at a predetermined distance, and a core part disposed between the first and second header tanks, having a plurality of tubes and fins, and configured to perform a movement of the cooling fluid and heat exchange of the cooling fluid, in which a predetermined space is formed in a longitudinal direction in a separation wall, which divides a flow path of the first or second header tank into a plurality of spaces in a width direction, so that condensate water is discharged.

12 Claims, 11 Drawing Sheets

(51) Int. Cl.
*F28F 9/22* (2006.01)
*F28F 17/00* (2006.01)

(58) Field of Classification Search
CPC ..... F28F 9/028; F28F 9/0204; F28F 9/0265; F28F 2009/222; F28F 2009/224; F28F 2009/226
See application file for complete search history.

(56) References Cited

U.S. PATENT DOCUMENTS

| | | | | |
|---|---|---|---|---|
| 2007/0163766 | A1* | 7/2007 | Fischer | F25B 39/022 165/174 |
| 2009/0266528 | A1* | 10/2009 | Saito | F25B 39/022 165/153 |
| 2018/0283748 | A1* | 10/2018 | Lee | F28F 9/028 |
| 2019/0120569 | A1* | 4/2019 | Dolderer | F28F 9/0229 |

FOREIGN PATENT DOCUMENTS

| | | | | |
|---|---|---|---|---|
| JP | 2010197019 | A | 9/2010 | |
| KR | 20130024733 | A | 3/2013 | |
| KR | 20180112675 | A | 10/2018 | |
| KR | 20200080157 | A * | 7/2020 | F28F 9/0258 |

* cited by examiner

HEAT EXCHANGER

CROSS REFERENCE TO RELATED APPLICATIONS

This patent application is a national phase under 35 U.S.C. § 371 of International Patent Application No. PCT/KR2022/020975 filed Dec. 21, 2022, which claims the benefit of priority from Korean Patent Application Nos. 10-2021-0184779 filed Dec. 22, 2021, and 10-2022-0179842 filed Dec. 20, 2022, each of which is hereby incorporated herein by reference in its entirety for all purposes.

TECHNICAL FIELD

The present invention relates to a heat exchanger, and more particularly, to a heat exchanger capable of ensuring sufficient cooling performance and drainage performance even in a narrow width.

BACKGROUND ART

A heat exchange system includes a heat exchanger configured to absorb heat from the surroundings, a compressor configured to compress a refrigerant or heat medium, a condenser configured to dissipate heat to the surroundings, and an expansion valve configured to expand the refrigerant or heat medium. In a cooling system of the heat exchange system, a gaseous refrigerant, which is introduced into the compressor from the heat exchanger, is compressed to a high temperature and a high pressure in the compressor, liquefaction heat is dissipated to the surroundings during a process in which the compressed gaseous refrigerant is liquefied while passing through a condenser, the liquefied refrigerant is converted into low-temperature, low-pressure wet saturated vapor while passing through the expansion valve again, and then the refrigerant is introduced into the heat exchanger again and then vaporized, such that a cycle is implemented, and a substantial cooling operation is performed by the heat exchanger in which a liquid refrigerant is vaporized by absorbing the amount of heat, which corresponds to vaporization heat, from the surroundings.

Recently, in vehicle industries, the efficiency of components and parts, which includes fuel economy, has been continuously improved. In addition, external appearances of vehicles also tend to be diversified to meet the needs of various consumers. In response to this trend, research and development have been steadily conducted to lighten, miniaturize, and highly functionalize the components of the vehicles. In particular, even in the case of cooling devices for vehicles, there have been continuous efforts to develop a heat exchange system capable of ensuring a sufficient space in an engine room, having a small size to reduce a necessary volume, and having high efficiency.

DISCLOSURE

Technical Problem

An object of the present invention is to improve efficiency by changing a structure of a heat exchanger and reduce costs.

Another object of the present invention is to propose a structure of a heat exchanger capable of ensuring sufficient cooling performance and drainage performance even though the heat exchanger is manufactured to have a narrow width.

Technical problems to be solved by the present invention are not limited to the above-mentioned technical problems, and other technical problems, which are not mentioned above, may be clearly understood by those skilled in the art from the following descriptions.

Technical Solution

In order to achieve the above-mentioned objects, an embodiment of the present invention provides a heat exchanger including: first and second header tanks into and from which a cooling fluid is introduced and discharged, the first and second header tanks being spaced apart from each other at a predetermined distance; and a core part disposed between the first and second header tanks, having a plurality of tubes and fins, and configured to perform a movement of the cooling fluid and heat exchange of the cooling fluid, in which the first or second header tank is divided into a plurality of spaces by a separation wall that divides a flow path in a width direction, and in which a predetermined space is formed in a longitudinal direction in the separation wall so that condensate water is discharged.

Advantageous Effects

According to the embodiment of the present invention, it is possible to reduce manufacturing costs for the heat exchanger in comparison with the related art.

In addition, it is possible to ensure sufficient heat exchange performance and drainage performance even in a narrow width.

In addition, it is possible to maintain a uniform distribution of the heat exchanger refrigerant and implement the effective condensate water discharge structure.

The various, beneficial advantages and effects of the present invention are not limited to the above-mentioned contents and may be more easily understood during the process of describing the specific embodiments of the present invention.

BEST MODE

Figure 1:
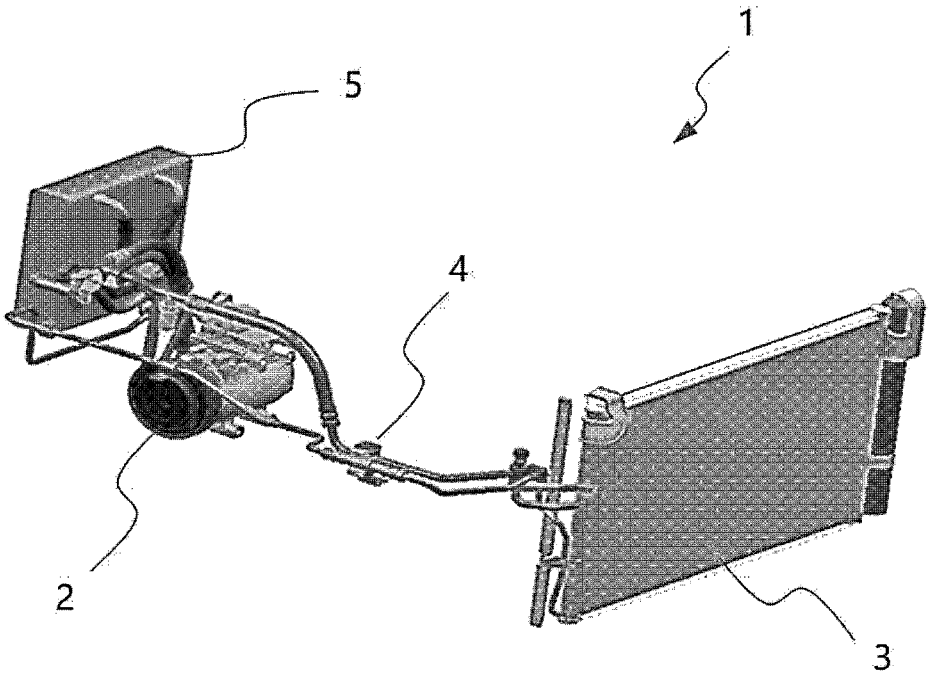
FIG. 1 is a view for explaining a structure of a general heat exchange system.

An embodiment of the present invention provides a heat exchanger including: first and second header tanks into and from which a cooling fluid is introduced and discharged, the first and second header tanks being spaced apart from each other at a predetermined distance; and a core part disposed between the first and second header tanks, having a plurality of tubes and fins, and configured to perform a movement of the cooling fluid and heat exchange of the cooling fluid, in which the first or second header tank is divided into a plurality of spaces by a separation wall that divides a flow path in a width direction, and in which a predetermined space is formed in a longitudinal direction in the separation wall so that condensate water is discharged.

In addition, the first or second header tank may include: an outer header plate configured to define an outer periphery of the header tank; and an inner header plate coupled to the plurality of tubes and the outer header plate and configured to define a closed cross-section, and the separation wall may be defined as a center of the inner header plate is bent toward the outer header plate.

In addition, the inner header plate may include: a first coupling surface coupled to one end of the outer header plate; a first tube accommodation surface formed to be bent from the first coupling surface at a predetermined angle and configured to accommodate the tube; a first partition wall bent from the first tube accommodation surface at a predetermined angle and configured to define the separation wall; a second coupling surface bent from the first partition wall at a predetermined angle and coupled to an inner peripheral surface of the outer header plate; a second partition wall bent from the second coupling surface at a predetermined angle and configured to define the separation wall; a second tube accommodation surface bent from the second partition wall at a predetermined angle and configured to accommodate the tube; and a third coupling surface bent from the second tube accommodation surface at a predetermined angle and coupled to the other end of the outer header plate.

In addition, the separation wall may include a first partition wall and a second partition wall, and the first partition wall and the second partition wall may be spaced apart from each other at a predetermined interval to define a predetermined space in the longitudinal direction.

In addition, the first header tank may further include a baffle configured to divide the flow path in the longitudinal direction, and a main communication hole and an auxiliary communication hole, which are formed through the first partition wall and the second partition wall, may be formed in the separation wall of the first header tank.

In addition, a main communication hole plate having a penetrated inner portion may be inserted between the first partition wall and the second partition wall at a position of the main communication hole, and an auxiliary communication hole plate having a penetrated inner portion may be inserted between the first partition wall and the second partition wall at a position of the auxiliary communication hole.

In addition, a plurality of caulking tabs may be formed at one side edge of the main communication hole plate and coupled to an outer header plate.

In addition, guide tabs, which guide the coupling to the outer header plate, may be formed between the plurality of caulking tabs, and the guide tab may protrude to a height lower than the caulking tab.

In addition, one or fewer tube may be inserted between one end of the main communication hole and the baffle configured to divide the flow path in the longitudinal direction.

In addition, the auxiliary communication hole may be spaced apart from the other end of the main communication hole at a distance longer than a distance between the main communication hole and the baffle.

In addition, an area of the auxiliary communication hole may be 6.5% or less of an area of the main communication hole.

In addition, the second header tank may include a plurality of throttle plates configured to adjust a flow rate in the longitudinal direction.

In addition, the first header tank and the second header tank may be divided in accordance with a flow of the fluid, a region in which the fluid is introduced into the first header tank may be a first tank zone, an end region of a first pass through which the fluid descends from the first tank zone to the second header tank may be a second tank zone, one end region of a second pass connected to the second tank zone in the longitudinal direction and configured to allow the fluid to ascend to the first header tank may be a third tank zone, the other end region of the second pass may be a fourth tank zone, a region connected to the fourth tank zone through the main communication hole and the auxiliary communication hole may be a fifth tank zone, an end region of a third pass through which the fluid descends from the fifth tank zone to the second header tank may be a sixth tank zone, one end region of a fourth pass connected to the sixth tank zone in the longitudinal direction and configured to allow the fluid to ascend to the first header tank may be a seventh tank zone, a region, which is the other end region of the fourth pass through which the fluid is discharged to the outside of the heat exchanger, may be an eighth tank zone, a first throttle plate may be disposed in the third tank zone, and a second throttle plate may be disposed in the seventh tank zone.

In addition, an opening cross-sectional area of the first throttle plate or the second throttle plate may be 25 to 30% of a tank cross-sectional area.

In addition, an opening cross-sectional area of the first throttle plate or the second throttle plate may be 18 to 21% of a tube flow path cross-sectional area.

In addition, the first throttle plate may be disposed to be deflected from a center of the third tank zone to the second tank zone, or the second throttle plate may be disposed to be deflected from a center of the seventh tank zone to the sixth tank zone.

In addition, the first throttle plate may be disposed to be deflected from the center of the third tank zone to the second tank zone by 8 to 9% of a length of the third tank zone, or the second throttle plate may be disposed to be deflected from the center of the seventh tank zone to the sixth tank zone by 11 to 12% of a length of the seventh tank zone.

MODE FOR INVENTION

Hereinafter, exemplary embodiments of the present invention will be described in detail with reference to the accompanying drawings. However, the technical spirit of the present invention is not limited to some embodiments described herein but may be implemented in various different forms. One or more of the constituent elements in the embodiments may be selectively combined and substituted within the scope of the technical spirit of the present invention. The same or corresponding constituent elements are assigned with the same reference numerals regardless of reference numerals, and the repetitive description thereof will be omitted.

In addition, unless otherwise specifically and explicitly defined and stated, the terms (including technical and scientific terms) used in the embodiments of the present invention may be construed as the meaning which may be commonly understood by the person with ordinary skill in the art to which the present invention pertains. The meanings of the commonly used terms such as the terms defined in dictionaries may be interpreted in consideration of the contextual meanings of the related technology.

In the present specification, unless particularly stated otherwise, a singular form may also include a plural form. The expression "at least one (or one or more) of A, B, and C" may include one or more of all combinations that can be made by combining A, B, and C. In addition, the terms first, second, A, B, (a), and (b) may be used to describe constituent elements of the embodiments of the present invention. These terms are used only for the purpose of discriminating one constituent element from another constituent element, and the nature, the sequences, or the orders of the constituent elements are not limited by the terms.

Further, when one constituent element is described as being 'connected,''coupled,' or 'attached' to another constituent element, one constituent element can be connected, coupled, or attached directly to another constituent element or connected, coupled, or attached to another constituent element through still another constituent element interposed therebetween. In addition, the explanation "one constituent element is formed or disposed above (on) or below (under) another constituent element" includes not only a case in which the two constituent elements are in direct contact with each other, but also a case in which one or more additional constituent elements are formed or disposed between the two constituent elements. In addition, the expression "above (on) or below (under)" may include a meaning of a downward direction as well as an upward direction based on one constituent element.

First, FIG. 1 illustrates a structure of a general heat exchange system 1. With reference to FIG. 1, the heat exchange system 1 includes a compressor 2 configured to compress a refrigerant or heat medium, a condenser 3 configured to dissipate heat to the surroundings, an expansion valve 4 configured to expand the refrigerant or heat medium, and an evaporator 5 configured to receive a liquid refrigerant, which is depressurized to a low temperature and a low pressure while passing through the expansion valve, and allow the liquid refrigerant to exchange heat with a cooling target object to absorb heat by means of liquid evaporation.

In this case, a thickness of the evaporator 5 directly affects cooling performance and a size of the heat exchange system 1. In case that a thickness of the evaporator 5 is large, sufficient cooling performance is easily achieved, but there is a problem in that a thickness of the heat exchange system 1 is also increased. On the contrary, in case that the evaporator is designed to be thin, the size of the heat exchange system 1 may decrease. However, it is difficult to achieve sufficient cooling performance, and there is a limitation in applying a structure for discharging condensate water produced in the evaporator 5, which adversely affects cooling performance, odor, corrosion, and the like. In particular, in case that the thickness of the evaporator is designed to be 40 mm or less to meet a recent demand for a reduction in volume of the heat exchange system for compact designs, it is difficult to implement a smooth condensate water discharge structure while achieving sufficient cooling performance. Therefore, the present invention proposes a structure capable of ensuring sufficient cooling performance and drainage performance even though the evaporator is manufactured to have a narrow width. Because the proposal of the present invention may be applied to a structure of a heat exchanger 1000 in addition to the evaporator 5, the embodiment of the present invention will be described in detail by using the term 'heat exchanger 1000 that is a high-level concept of the evaporator.

Figure 2:
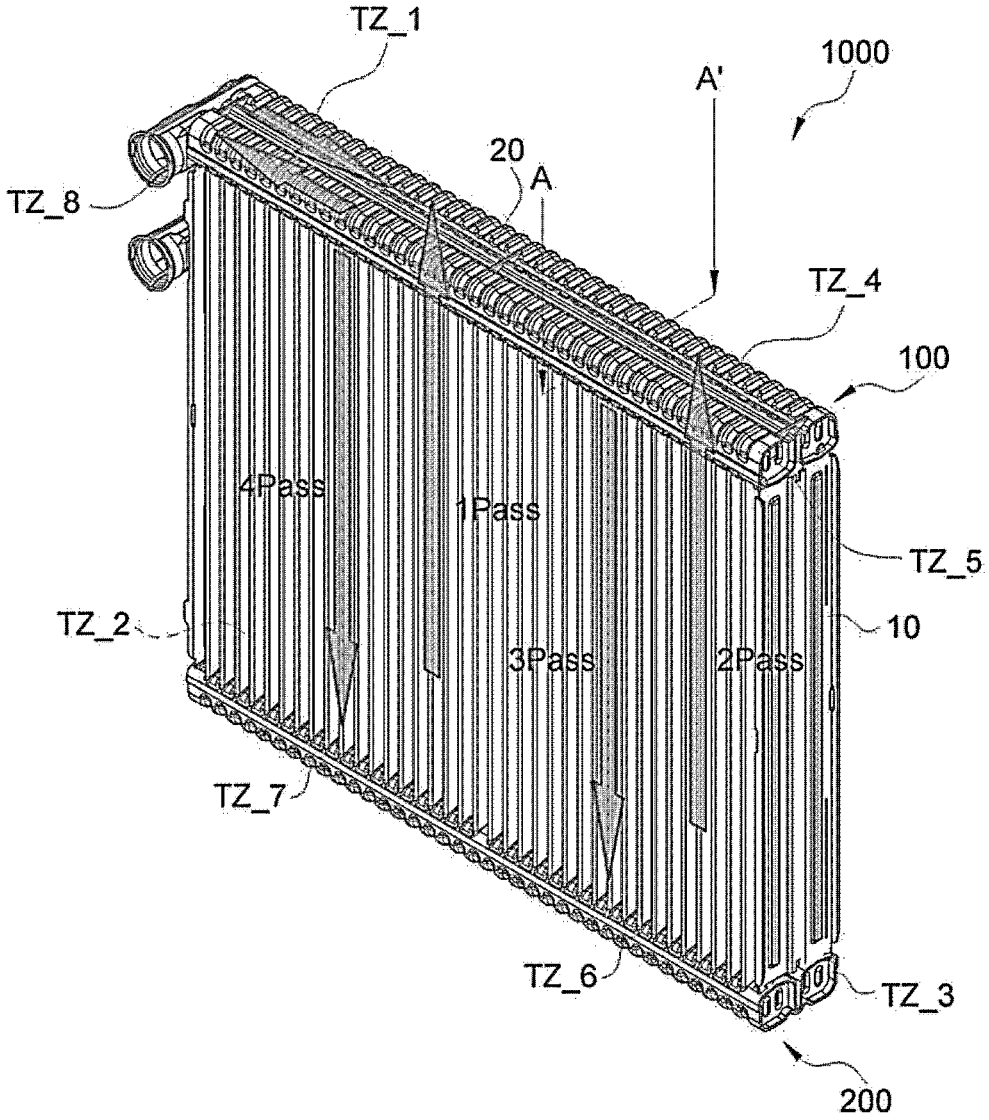
FIG. 2 is a perspective view for explaining a flow path structure of a heat exchanger according to an embodiment of the present invention.

First, FIG. 2 illustrates a flow path structure of the heat exchanger 1000 according to the embodiment of the present invention. With reference to FIG. 2, a fluid is introduced into a first tank zone TZ_1 of a first header tank 100, which is positioned at an upper side, from the outside, the fluid descends from the first tank zone TZ_1 to a second tank zone TZ_2 of a second header tank 200 through a first pass, and the fluid passes through a third tank zone TZ_3, which is connected to the second tank zone TZ_2 in a longitudinal direction, and ascends to the first header tank 100 through a second pass. The fluid, which has ascended, is introduced into a fourth tank zone TZ_4 of the first header tank 100 and introduced into a fifth tank zone TZ_5 through a communication hole, and then the fluid descends to a sixth tank zone TZ_6 of the second header tank 200 through a third pass. Thereafter, the fluid flows so that the fluid passes through a seventh tank zone TZ_7, which is connected to the sixth tank zone TZ_6 in the longitudinal direction, and is introduced into an eighth tank zone TZ_8 of the first header tank 100 through a fourth pass, and then the fluid is discharged to the outside from the eighth tank zone TZ_8.

In this case, in the first header tank 100, a flow path is divided in a width direction by a separation wall, and the flow path is divided in the longitudinal direction by a baffle, such that the plurality of tank zones is distinguished.

Figure 3:
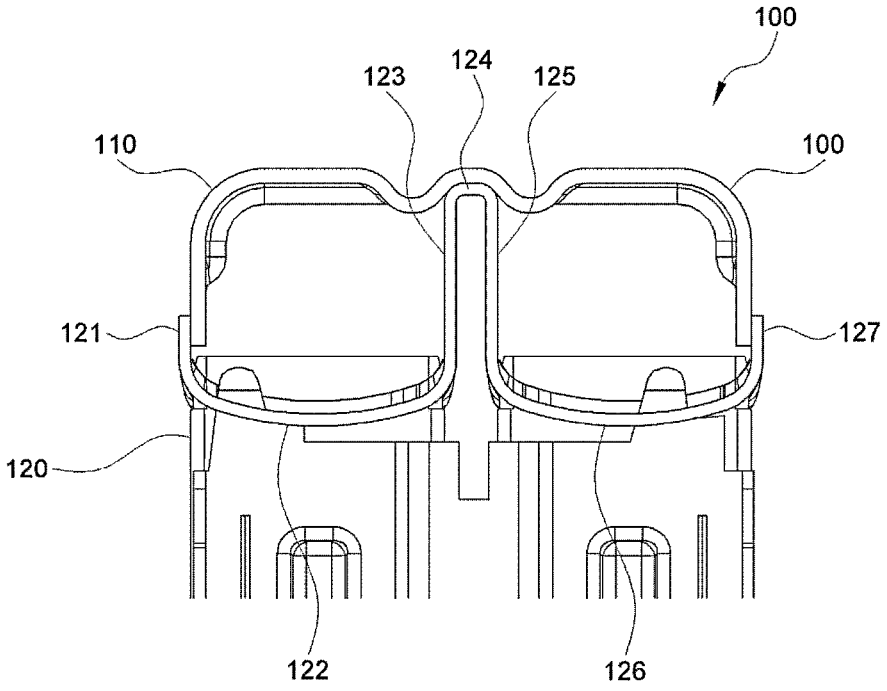
FIG. 3 is a cross-sectional view taken along line A-A' in FIG. 2.

FIG. 3 is a cross-sectional view taken along line A-A' in FIG. 2. With reference to FIG. 3, the first header tank 100 of the present invention includes an outer header plate 110 configured to define an outer periphery of the header tank, and an inner header plate 120 coupled to a plurality of tubes and the outer header plate 110 and configured to define a closed cross-section. In this case, a center of the inner header plate 120 is bent toward the outer header plate 110, such that the separation wall is defined. As described above, the flow path of the first header tank 100 is divided into plurality of spaces in the width direction by the separation wall.

The structure of the inner header plate 120 will be described in more detail. The inner header plate 120 according to the embodiment of the present invention includes a first coupling surface 121 coupled to one end of the outer header plate 110, a first tube accommodation surface 122 formed to be bent from the first coupling surface 121 at a predetermined angle and configured to accommodate the tube, a first partition wall 123 bent from the first tube accommodation surface 122 at a predetermined angle and configured to define the separation wall, a second coupling surface 124 bent from the first partition wall 123 at a predetermined angle and coupled to an inner peripheral surface of the outer header plate 110, a second partition wall 125 bent from the second coupling surface 124 at a predetermined angle and configured to define the separation wall, a second tube accommodation surface 126 formed to be bent from the second partition wall 125 at a predetermined angle and configured to accommodate the tube, and a third coupling surface 127 bent from the second tube accommodation surface 126 at a predetermined angle and coupled to the other end of the outer header plate 110.

Therefore, condensate water is discharged through a space of the separation wall, which is formed as the inner header plate 120 is bent upward, which may improve condensate water discharge performance.

Figure 4:
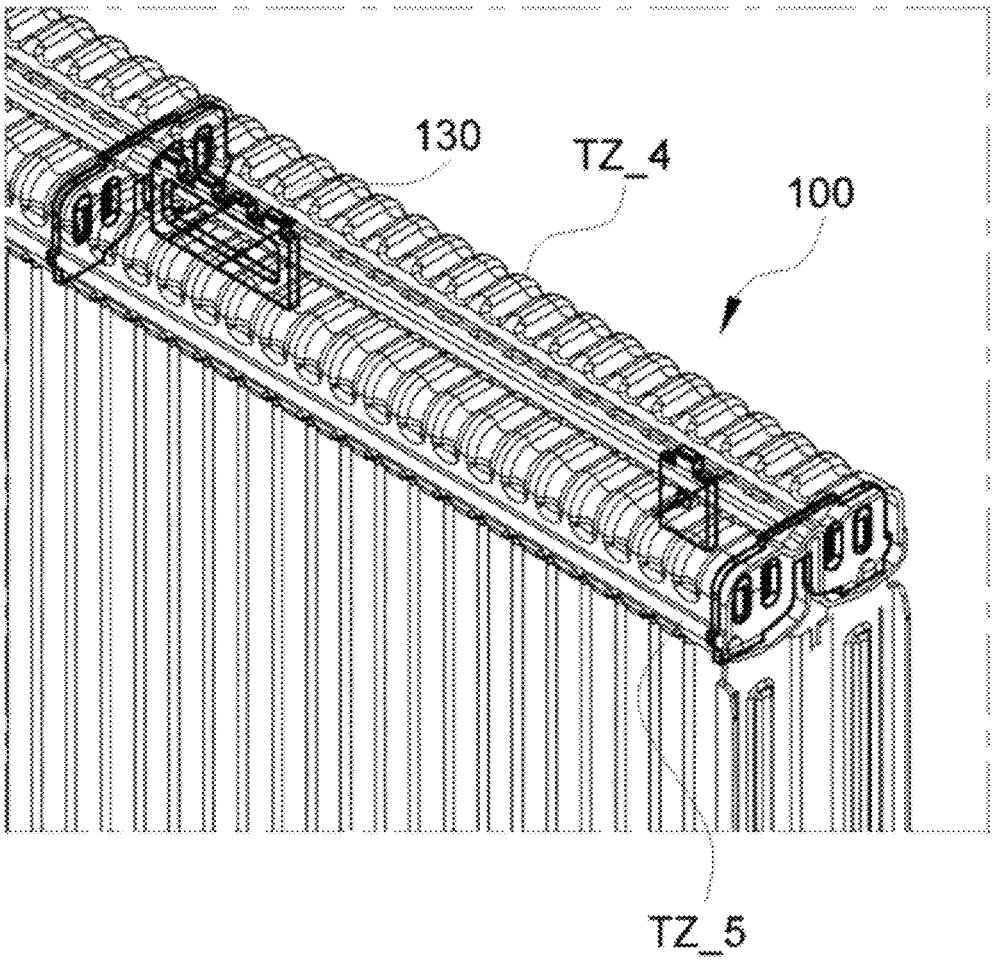
FIG. 4 is a view illustrating a communication hole according to the embodiment of the present invention.

FIG. 4 is a view illustrating the communication hole according to the embodiment of the present invention. With reference to FIG. 4, a main communication hole 130 and an auxiliary communication hole 140, which are formed through the first partition wall 123 and the second partition wall 125, are formed in the separation wall of the first header tank 100, and the fluid moves from the fourth tank zone TZ_4 to the fifth tank zone TZ_5 through the main communication hole 130 and the auxiliary communication hole 140. In this case, the main communication hole 130 may be formed to be close to the baffle at the center, and the auxiliary communication hole 140 may be disposed to be spaced apart from the other end of the main communication hole 130 at a distance longer than a distance between the main communication hole 130 and the baffle.

Figure 5:
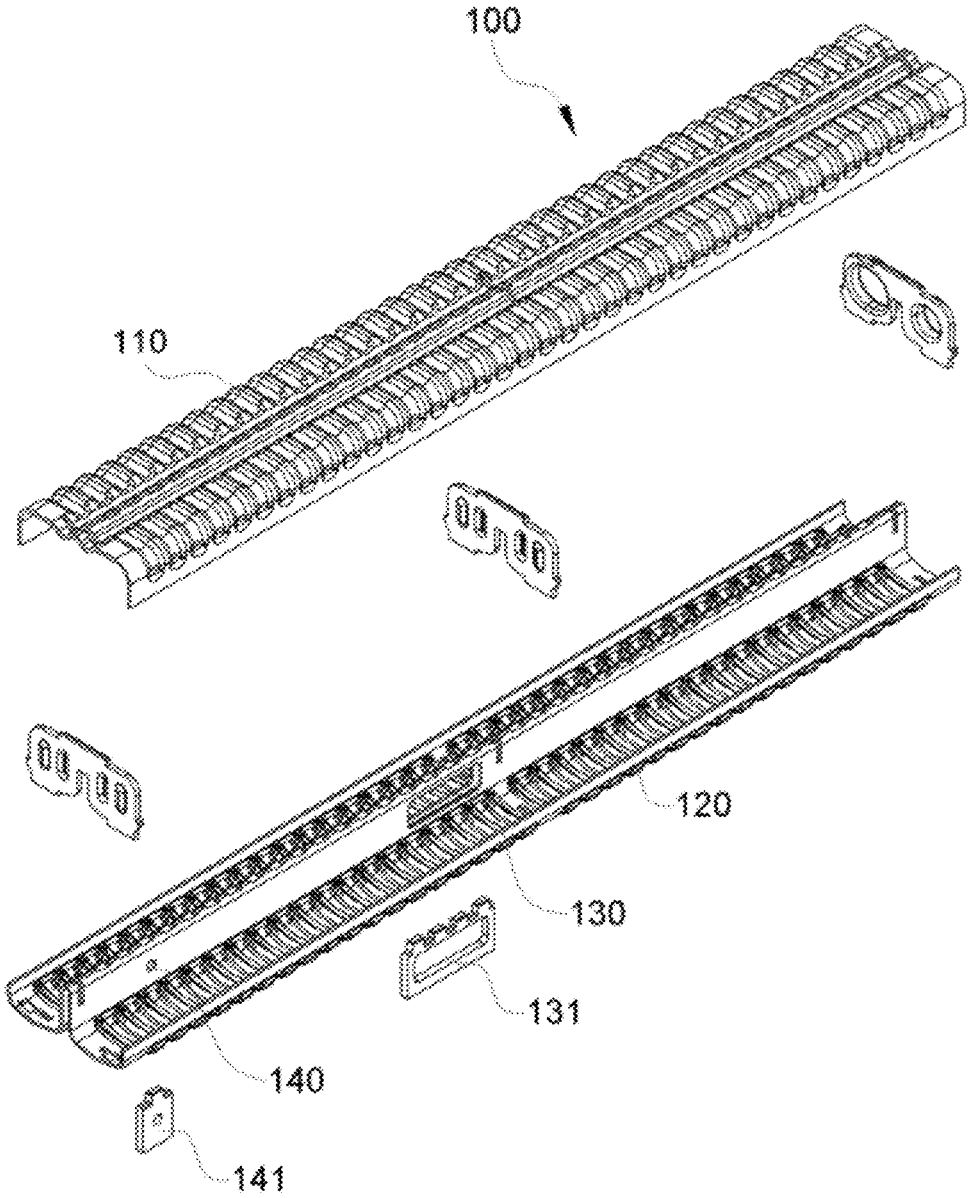
FIG. 5 is an exploded perspective view of a header tank according to the embodiment of the present invention.

FIG. 5 is an exploded perspective view of the header tank according to the embodiment of the present invention. A structure of the first header tank 100 will be described with reference to FIG. 5. The first header tank 100 includes the outer header plate 110 configured to define the outer periphery of the header tank, and the inner header plate 120 coupled to the plurality of tubes and the outer header plate 110 and configured to define the closed cross-section. The separation wall is defined by the first partition wall 123 and the second partition wall 125 made by bending the center of the inner header plate 120 toward the outer header plate 110. The flow path of the first header tank 100 is divided into the plurality of spaces in the width direction by the separation wall.

The main communication hole 130 and the auxiliary communication hole 140, which are formed through the first partition wall 123 and the second partition wall 125, are formed in the separation wall of the first header tank 100, and the fluid moves from the fourth tank zone TZ_4 to the fifth tank zone TZ_5 through the main communication hole 130 and the auxiliary communication hole 140. A main communication hole plate 131 having a penetrated inner portion is inserted between the first partition wall 123 and the second partition wall 125 at a position of the main communication hole 130, and an auxiliary communication hole plate 140 having a penetrated inner portion is inserted between the first partition wall 123 and the second partition wall 125 at a position of the auxiliary communication hole 140.

Meanwhile, a flow path baffle having a fluid inlet hole is disposed at one end of the first header tank 100 based on the longitudinal direction, and the baffles, which block the flow path, are disposed at the other end and the center of the first header tank 100 based on the longitudinal direction.

Figure 6:
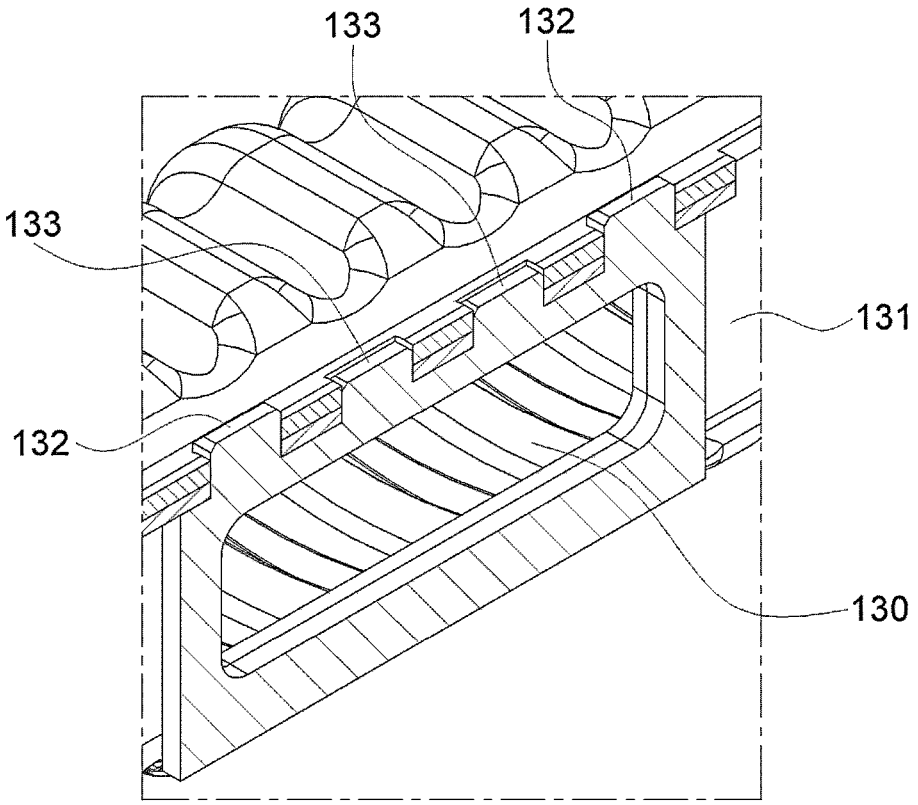
FIG. 6 is a view illustrating a main communication hole and a main communication hole plate according to the embodiment of the present invention.

FIG. 6 is a view illustrating the main communication hole 130 and the main communication hole plate 131 according to the embodiment of the present invention. With reference to FIG. 6, a plurality of caulking tabs 132, which is coupled to the outer header plate 110, is formed at one side edge of the main communication hole plate 131. Guide tabs 133, which guide the coupling to the outer header plate 110, are formed between the plurality of caulking tabs 132. The guide tab 133 protrudes to a height lower than the caulking tab 132, such that the main communication hole plate 131 aligns the position of the outer header plate 110.

Figure 7:
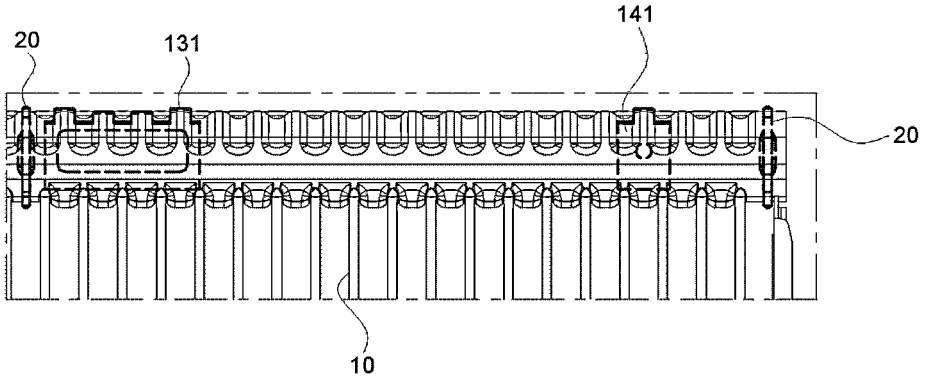
FIG. 7 is a view illustrating a relationship between a baffle and the main communication hole plate according to the embodiment of the present invention.

FIG. 7 is a view illustrating a relationship between the baffle and the main communication hole plate 131 according to the embodiment of the present invention. With reference to FIG. 7, as described above, the main communication hole 130 may be disposed to be close to the baffle at the center. More particularly, one or fewer tube may be inserted between one end of the main communication hole 130 and the baffle positioned inward and configured to divide the flow path in the longitudinal direction. Meanwhile, two to three tubes may be inserted between the auxiliary communication hole plate 141 and the baffle positioned at the other end of the first header tank 100.

Table 1 below shows a result of comparing and testing performance and a core part temperature difference while changing area ratios to the main communication hole 130 in a case (Base) in which the auxiliary communication hole 140 is not present and a case in which the auxiliary communication hole 140 is present. As shown in Table 1, it can be ascertained that in Case 4 in which the area ratio is 6.5%, the core part temperature difference is uniformized as 45% in comparison with Base, and the performance is also as high as 100.8% and higher than that in Base.

TABLE 1

| | Base | Case 1 | Case 2 | Case 3 | Case 4 | Case 5 |
|---|---|---|---|---|---|---|
| Area ratio | No auxiliary communication hole | 20% | 14.7% | 10.2% | 6.5% | 3.7% |
| Performance ratio | 100% (Reference) | 97.9% | 98.8% | 98.7% | 100.8% | 101.7% |
| Core part temperature difference ratio | 100% (Reference) | 91% | 82% | 82% | 45% | 36% |

Therefore, it can be ascertained that the auxiliary communication hole 140 is formed to have a smaller area than the main communication hole 130, and a distribution of the refrigerant is uniformized as the area of the auxiliary communication hole 140 is smaller than the area of the main communication hole 130, such that the temperature distribution may be improved. Particularly, when the area of the auxiliary communication hole 140 is 6.5% or less of the area of the main communication hole 130, the uniform distribution of the refrigerant may be maintained, the drainage performance may be improved, and condensate water may be effectively discharged.

Figure 8:
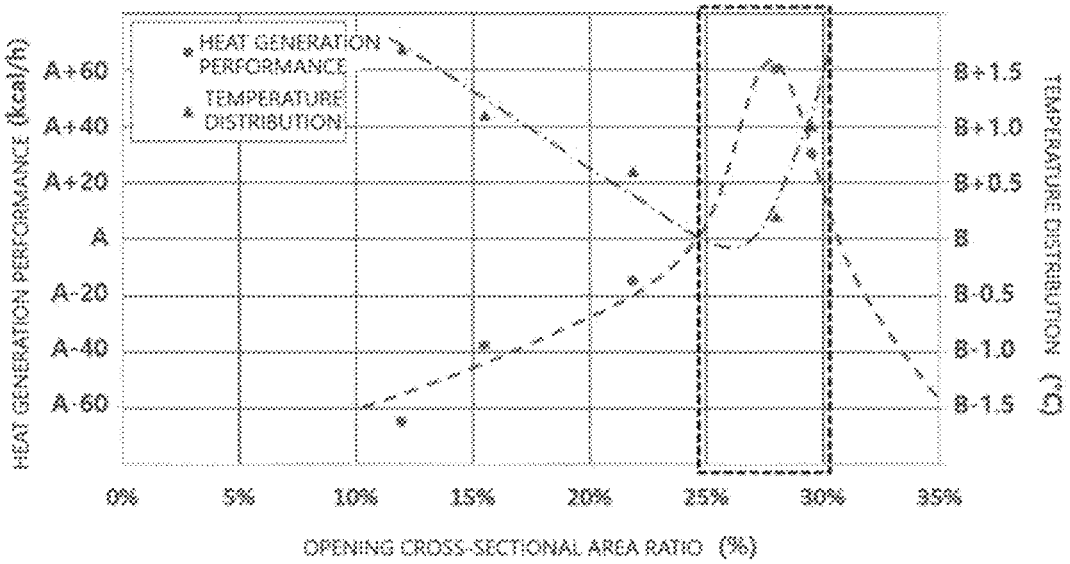
FIG. 8 is a view illustrating a throttle plate according to the embodiment of the present invention.

FIG. 8 is a view illustrating a throttle plate according to the embodiment of the present invention. With reference to FIG. 8, the second header tank 200 includes a plurality of throttle plates configured to adjust a flow rate in the longitudinal direction. In this case, a first throttle plate 210 may be disposed in the above-mentioned third tank zone TZ_3, and a second throttle plate 220 may be disposed in the seventh tank zone TZ_7. As described above, the two throttle plates are disposed in the tank zones of the second header tank 200, such that the refrigerant is distributed equally to the tubes, which improves the cooling performance and the temperature distribution. Even though the structure of the second header tank 200 is not illustrated in detail in the drawings, the second header tank 200 is identical in configuration to the first header tank 100, except for the components such as the center baffle and the communication hole.

Figure 9:
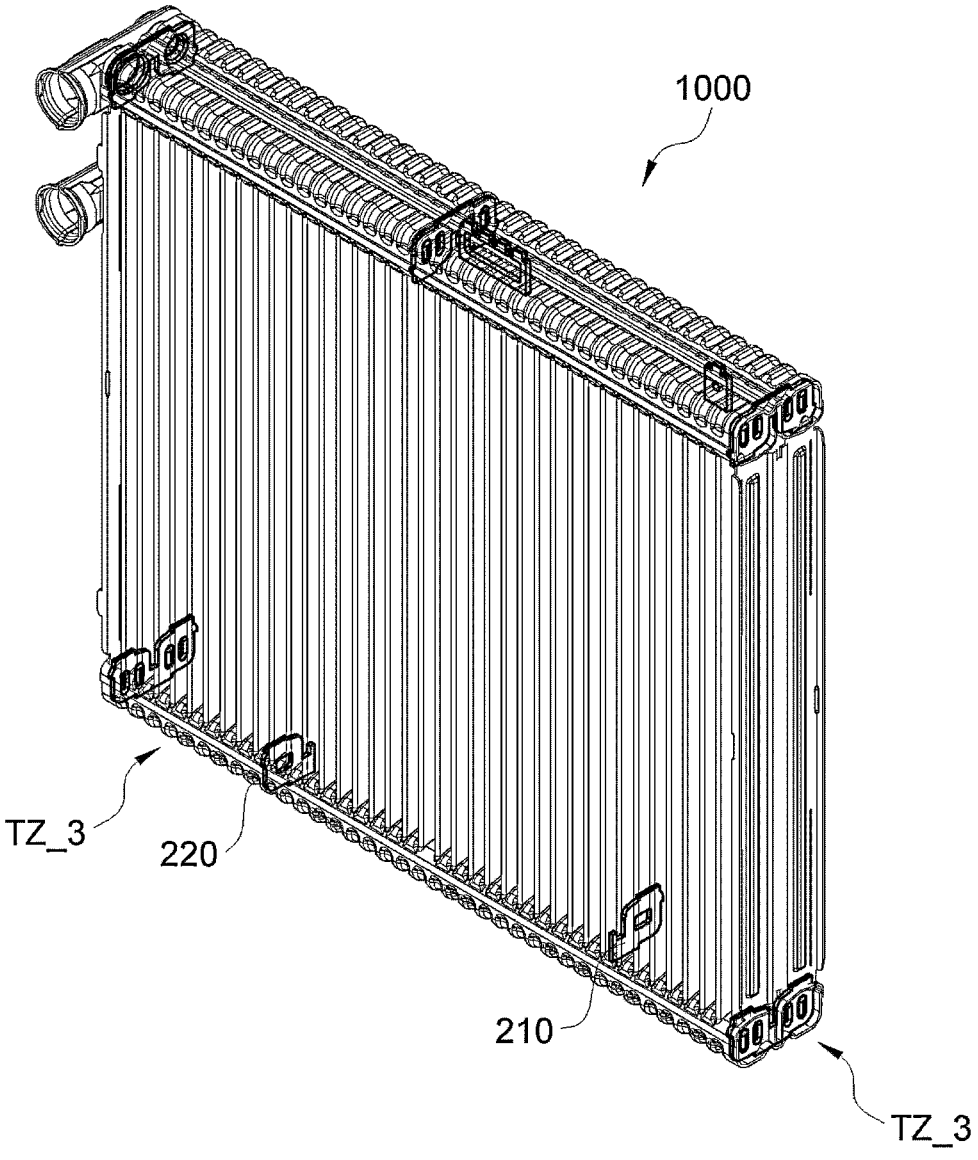
FIG. 9 is a test result graph showing heat generation performance and a temperature distribution effect in accordance with an opening cross-sectional area ratio between a throttle plate and a tank cross-section.

Meanwhile, an area of the throttle plate affects heat generation performance and a temperature distribution of the heat exchanger. FIG. 9 is a test result graph showing heat generation performance and a temperature distribution effect in accordance with an opening cross-sectional area ratio between the throttle plate and a tank cross-section. An effect of the opening cross-sectional area ratio of the throttle plate on the heat generation performance and the temperature distribution of the heat exchanger will be described with reference to FIG. 9.

The test result in FIG. 9 will be described in detail. The heat generation performance and the temperature distributions were compared and tested by changing the opening cross-sectional area of the first throttle plate 210 or the second throttle plate 220 to 10 to 30% of the tank cross-sectional area. The left side of the graph indicates a relative heat generation performance test value when a reference heat generation performance is A, and the right side of the graph indicates a relative temperature distribution test value when a reference temperature distribution is B. It is interpreted that the better result is achieved as the heat generation performance becomes higher and the temperature distribution becomes smaller.

According to the test result, it can be ascertained that when the opening cross-sectional area of the first throttle plate 210 or the second throttle plate 220 has a range of 25 to 30% of the tank cross-sectional area, the heat generation performance, which is higher than a criterion, and the temperature distribution does not significantly deviate from the criterion. That is, when the first throttle plate 210 or the second throttle plate 220 is within the 25 to 30% of the tank cross-sectional area, the temperature distribution is not significantly degraded, and the high heat generation performance is exhibited.

Figure 10:
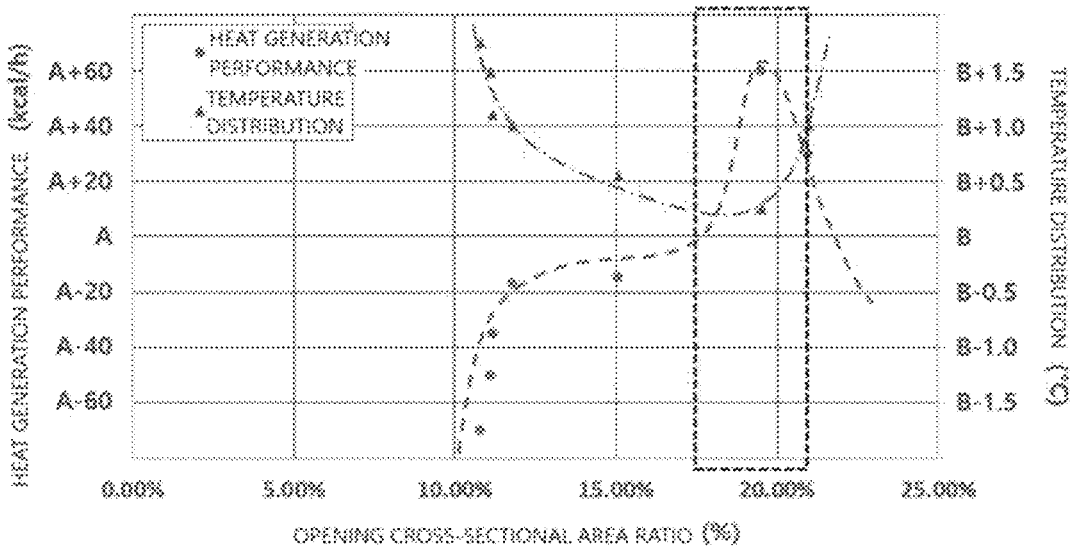
FIG. 10 is a test result graph showing heat generation performance and a temperature distribution effect in accordance with an opening cross-sectional area ratio between the throttle plate and a tube flow path cross-section.

In addition, the opening cross-sectional area ratio between the throttle plate and the tube flow path cross-section also affects the heat generation performance and the temperature distribution of the heat exchanger. FIG. 10 is a test result graph showing heat generation performance and a temperature distribution effect in accordance with an opening cross-sectional area ratio between the throttle plate and a tube flow path cross-section. An effect of the opening cross-sectional area ratio between the throttle plate and the tube flow path cross-section on the heat generation performance and the temperature distribution of the heat exchanger will be described with reference to FIG. 10.

The horizontal axis in FIG. 10 indicates the ratio of the opening cross-sectional area of the first or second throttle plate to the cross-sectional area of the tube flow path, the left side of the graph indicates a relative heat generation performance test value when a reference heat generation performance is A, and the right side of the graph indicates a relative temperature distribution test value when a reference temperature distribution is B. It is interpreted that the better result is achieved as the heat generation performance becomes higher and the temperature distribution becomes smaller.

According to the test result, it can be ascertained that when the opening cross-sectional area of the first throttle plate 210 or the second throttle plate 220 has a range of 18 to 21% of the tube flow path cross-sectional area, the heat generation performance, which is higher than a criterion, and the temperature distribution does not significantly deviate from the criterion. That is, when the first throttle plate 210 or the second throttle plate 220 is within the 18 to 21% of the tank cross-sectional area, the temperature distribution is not significantly degraded, and the high heat generation performance is exhibited.

Figure 11:
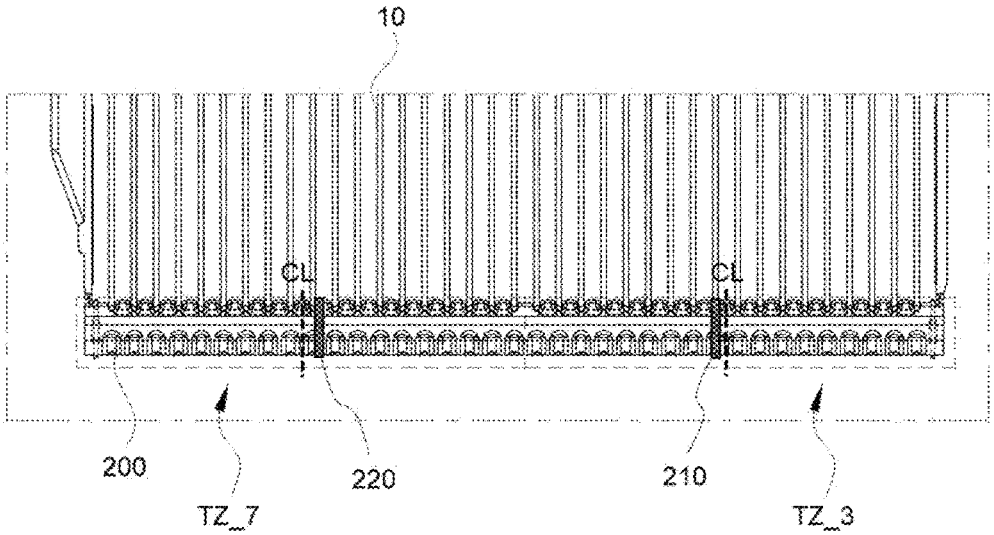
FIG. 11 is a view for explaining a position of the throttle plate.

Meanwhile, the position of the throttle plate is appropriately disposed to be slightly deflected from the center of each of the tank zones. FIG. 11 is a view for explaining a deflection position of the throttle plate. With reference to FIG. 11, the first throttle plate 210 is appropriately disposed to be deflected from the center of the third tank zone TZ_3 toward the center of the second header tank 200, and the second throttle plate 220 is appropriately disposed to be deflected from the center of the seventh tank zone TZ_7 toward the center of the second header tank 200.

An effect of the deflection of the throttle plate on the heat generation performance and the temperature distribution of the heat exchanger will be described with reference to Table 2 below and FIGS. 12 and 13.

TABLE 2

| | Case 1 | Case 2 | Case 3 | Case 4 | Case 5 |
|---|---|---|---|---|---|
| First throttle plate deflection ratio (%) | −22.2% | −11.9% | −1.6% | +8.7% | +19.0% |
| Second throttle plate deflection ratio (%) | −20.7% | −9.9% | −1.0% | +11.9% | +22.8% |

Table 2 shows deflection ratios of the first throttle plate and the second throttle plate for respective test cases. In this case, '+' and '−' indicate deflection positions, '+' means the deflection toward the center of the entire heat exchanger, and '−' means the deflection toward the side opposite to the center. For example, '+' means a case in which the first throttle plate 210 moves from the center of the third tank zone TZ_3 toward the second tank zone TZ_2, and '+' means a case in which the second throttle plate 220 moves from the center of the seventh tank zone TZ_7 to the sixth tank zone TZ_6. Meanwhile, the amount of deflection is represented by percentage of a deflection length to a length of each of the tank zones.

Figure 12:
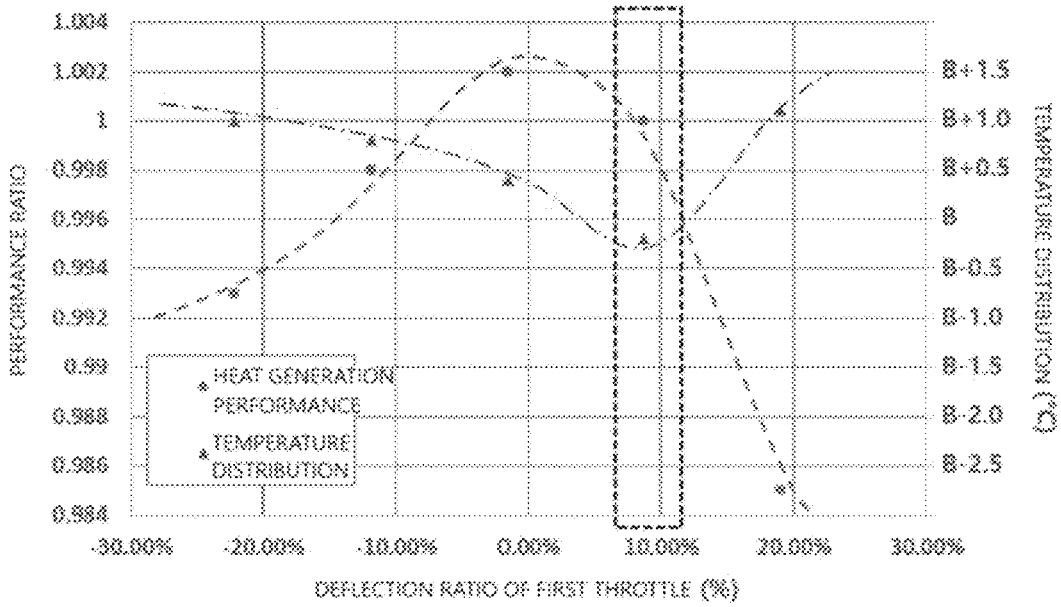
FIG. 12 is a test result graph showing heat generation performance and a temperature distribution effect in accordance with a deflection ratio of a first throttle plate.
Figure 13:
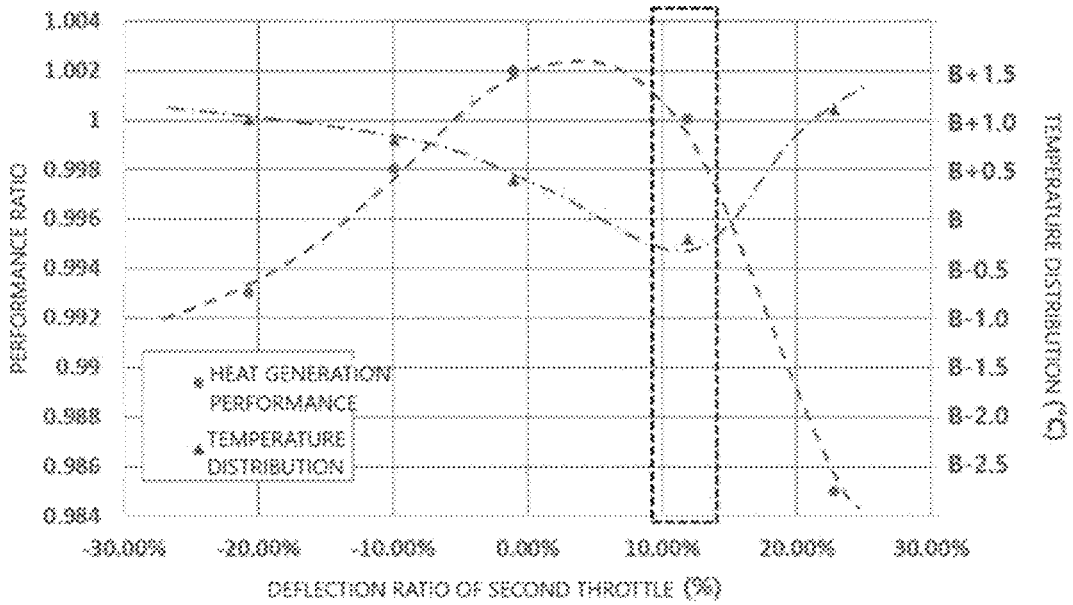
FIG. 13 is a test result graph showing heat generation performance and a temperature distribution effect in accordance with a deflection ratio of a second throttle plate.

FIG. 12 is a test result graph showing heat generation performance and a temperature distribution effect in accordance with a deflection ratio of the first throttle plate, and FIG. 13 is a test result graph showing heat generation performance and a temperature distribution effect in accordance with a deflection ratio of the second throttle plate. The left sides of the graphs indicate performance ratios configured to predict the criteria, and the right sides of the graphs indicate temperature distributions.

With reference to FIG. 12, it is shown that when the deflection ratio of the first throttle plate is 8 to 9%, the heat generation performance is maintained, and the effect of reducing the temperature distribution is excellent. With reference to FIG. 13, it is shown that when the deflection ratio of the second throttle plate is 11 to 12%, the heat generation performance is maintained, and the effect of reducing the temperature distribution is excellent.

That is, the first throttle plate 210 is appropriately disposed to be deflected from the center of the third tank zone TZ_3 to the second tank zone TZ_2 by 8 to 9% of the length of the third tank zone TZ_3, and the second throttle plate 220 is appropriately disposed to be deflected from the center of the seventh tank zone TZ_7 to the sixth tank zone TZ_6 by 11 to 12% of the length of the seventh tank zone TZ_7.

The embodiment of the present invention has been specifically described above with reference to the accompanying drawings.

The above description is simply given for illustratively describing the technical spirit of the present invention, and those skilled in the art to which the present invention pertains will appreciate that various modifications, changes, and substitutions are possible without departing from the essential characteristic of the present invention.

Accordingly, the embodiments disclosed in the present invention and the accompanying drawings are intended not to limit but to describe the technical spirit of the present invention, and the scope of the technical spirit of the present invention is not limited by the embodiments and the accompanying drawings. The protective scope of the present invention should be construed based on the following claims, and all the technical spirit in the equivalent scope thereto should be construed as falling within the scope of the present invention.

INDUSTRIAL APPLICABILITY

The present invention relates to the heat exchanger and is industrially available.

The invention claimed is:

1. A heat exchanger comprising:

first and second header tanks into and from which a cooling fluid is introduced and discharged, the first and second header tanks being spaced apart from each other at a predetermined distance; and a core part disposed between the first and second header tanks, having a plurality of tubes and fins, and configured to perform a movement of the cooling fluid and heat exchange of the cooling fluid, wherein the first or second header tank is divided into a plurality of spaces by a separation wall that divides a flow path in a width direction, and wherein a predetermined space is formed in a longitudinal direction in the separation wall so that condensate water is discharged, wherein the separation wall comprises a first partition wall and a second partition wall, and wherein the first partition wall and the second partition wall are spaced apart from each other at a predetermined interval to define a predetermined space in the longitudinal direction, wherein the first header tank further comprises a baffle configured to divide the flow path in the longitudinal direction, and wherein a main communication hole and an auxiliary communication hole, which are formed through the first partition wall and the second partition wall, are formed in the separation wall of the first header tank, wherein a main communication hole plate having a penetrated inner portion is inserted between the first partition wall and the second partition wall at a position of the main communication hole, and an auxiliary communication hole plate having a penetrated inner portion is inserted between the first partition wall and the second partition wall at a position of the auxiliary communication hole, wherein a plurality of caulking tabs is formed at one side edge of the main communication hole plate and coupled to an outer header plate configured to define an outer periphery of the header tank, wherein guide tabs, which guide the coupling to the outer header plate, is formed between the plurality of caulking tabs, and the guide tabs protrude to a height lower than the caulking tabs.

2. The heat exchanger of claim 1, wherein the first or second header tank comprises:

an outer header plate configured to define an outer periphery of the header tank; and an inner header plate coupled to the plurality of tubes and the outer header plate and configured to define a closed cross-section, and wherein the separation wall is defined as a center of the inner header plate is bent toward the outer header plate.

3. The heat exchanger of claim 2, wherein the inner header plate comprises:

a first coupling surface coupled to one end of the outer header plate;

a first tube accommodation surface formed to be bent from the first coupling surface at a predetermined angle and configured to accommodate the tube;

a first partition wall bent from the first tube accommodation surface at a predetermined angle and configured to define the separation wall;

a second coupling surface bent from the first partition wall at a predetermined angle and coupled to an inner peripheral surface of the outer header plate;

a second partition wall bent from the second coupling surface at a predetermined angle and configured to define the separation wall;

a second tube accommodation surface bent from the second partition wall at a predetermined angle and configured to accommodate the tube; and a third coupling surface bent from the second tube accommodation surface at a predetermined angle and coupled to the other end of the outer header plate.

4. The heat exchanger of claim 1, wherein one tube of the plurality of tubes is inserted between one end of the main communication hole and the baffle configured to divide the flow path in the longitudinal direction.

5. The heat exchanger of claim 4, wherein the auxiliary communication hole is spaced apart from the other end of the main communication hole at a distance longer than a distance between the main communication hole and the baffle.

6. The heat exchanger of claim 5, wherein an area of the auxiliary communication hole is 6.5% or less of an area of the main communication hole.

7. The heat exchanger of claim 1, wherein the second header tank comprises a plurality of throttle plates configured to adjust a flow rate in the longitudinal direction.

8. A heat exchanger comprising:

first and second header tanks into and from which a cooling fluid is introduced and discharged, the first and second header tanks being spaced apart from each other at a predetermined distance; and a core part disposed between the first and second header tanks, having a plurality of tubes and fins, and configured to perform a movement of the cooling fluid and heat exchange of the cooling fluid, wherein the first or second header tank is divided into a plurality of spaces by a separation wall that divides a flow path in a width direction, and wherein a predetermined space is formed in a longitudinal direction in the separation wall so that condensate water is discharged, wherein the separation wall comprises a first partition wall and a second partition wall, and wherein the first partition wall and the second partition wall are spaced apart from each other at a predetermined interval to define a predetermined space in the longitudinal direction, wherein the first header tank further comprises a baffle configured to divide the flow path in the longitudinal direction, and wherein a main communication hole and an auxiliary communication hole, which are formed through the first partition wall and the second partition wall, are formed in the separation wall of the first header tank, wherein the second header tank comprises a plurality of throttle plates configured to adjust a flow rate in the longitudinal direction, wherein the first header tank and the second header tank are divided in accordance with a flow of the fluid, a region in which the fluid is introduced into the first header tank is a first tank zone, an end region of a first pass through which the fluid descends from the first tank zone to the second header tank is a second tank zone, one end region of a second pass connected to the second tank zone in the longitudinal direction and configured to allow the fluid to ascend to the first header tank is a third tank zone, the other end region of the second pass is a fourth tank zone, a region connected to the fourth tank zone through the main communication hole and the auxiliary communication hole is a fifth tank zone, an end region of a third pass through which the fluid descends from the fifth tank zone to the second header tank is a sixth tank zone, one end region of a fourth pass connected to the sixth tank zone in the longitudinal direction and configured to allow the fluid to ascend to the first header tank is a seventh tank zone, a region, which is the other end region of the fourth pass through which the fluid is discharged to the outside of the heat exchanger, is an eighth tank zone, a first throttle plate is disposed in the third tank zone, and a second throttle plate is disposed in the seventh tank zone.

9. The heat exchanger of claim 8, wherein an opening cross-sectional area of the first throttle plate or the second throttle plate is 25 to 30% of a tank cross-sectional area.

10. The heat exchanger of claim 8, wherein an opening cross-sectional area of the first throttle plate or the second throttle plate is 18 to 21% of a tube flow path cross-sectional area.

11. The heat exchanger of claim 8, wherein the first throttle plate is disposed to be deflected from a center of the third tank zone to the second tank zone, or the second throttle plate is disposed to be deflected from a center of the seventh tank zone to the sixth tank zone.

12. The heat exchanger of claim 11, wherein the first throttle plate is disposed to be deflected from the center of the third tank zone to the second tank zone by 8 to 9% of a length of the third tank zone, or the second throttle plate is disposed to be deflected from the center of the seventh tank zone to the sixth tank zone by 11 to 12% of a length of the seventh tank zone.

* * * * *